US005200730A

United States Patent [19]

Masuda et al.

[11] Patent Number: 5,200,730

[45] Date of Patent: Apr. 6, 1993

[54] PREMOLDED SUPPRESSOR SLEEVE

[75] Inventors: Kiyoshi Masuda, New York, N.Y.; James May, Scranton, Pa.; Takao Otsuka, Kawasaki; Michio Inamura, Ayase, both of Japan

[73] Assignee: FerriShield, Inc., New York, N.Y.

[21] Appl. No.: 778,514

[22] Filed: Oct. 18, 1991

[51] Int. Cl.[5] ..... H01F 27/02; H01F 17/06

[52] U.S. Cl. ..... 336/90; 333/12; 336/175

[58] Field of Search ..... 336/174, 175, 176, 92, 336/229, 212, 210, 90; 174/92, 65 R, 84 R; 324/127; 333/81 R, 12, 182, 183, 243

[56] References Cited

U.S. PATENT DOCUMENTS

| | | | |
|---|---|---|---|
| 2,932,805 | 4/1960 | Doherty | 333/183 |
| 3,462,715 | 8/1969 | Shor | 333/183 |
| 4,873,505 | 10/1989 | Matsui | 336/176 |
| 4,885,559 | 12/1989 | Nakano | 336/176 |
| 5,003,278 | 3/1991 | May | 336/175 |

FOREIGN PATENT DOCUMENTS

| | | | |
|---|---|---|---|
| 60-133610 | 9/1985 | Japan | 336/175 |
| 61-38714 | 3/1986 | Japan | 336/175 |
| 61-116021 | 7/1986 | Japan | 336/175 |
| 63-165815 | 10/1988 | Japan | 336/176 |
| 63-172109 | 11/1988 | Japan | 336/176 |
| 833790 | 4/1960 | United Kingdom | 336/175 |

*Primary Examiner*—Thomas J. Kozma
*Attorney, Agent, or Firm*—Notaro & Michalos

[57] ABSTRACT

A noise suppressor for engagement over a cable, comprises a ferrite core having a core passage extending therethrough from one end to the other. A sleeve of resilient insulating material is cast, injected, dipped or molded over the ferrite core to cover the core. The sleeve includes on opposite sides thereof, a sleeve passage communicating with the core passage. One of the projections may be resilient or may be replaced by a closed end of the sleeve with a slit, for closely engaging a cable to fix the sleeve at a selected location along the cable. A pad may be included in one or both of the sleeves to further hold the sleeves securely on the cable. The sleeve may have a cylindrical or rectangular cross section to accommodate cylindrical or ribbon shaped cables.

3 Claims, 6 Drawing Sheets

FIG. 7
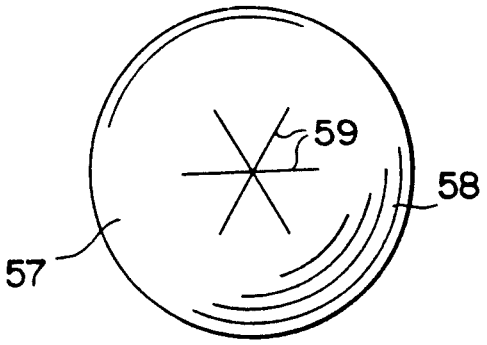
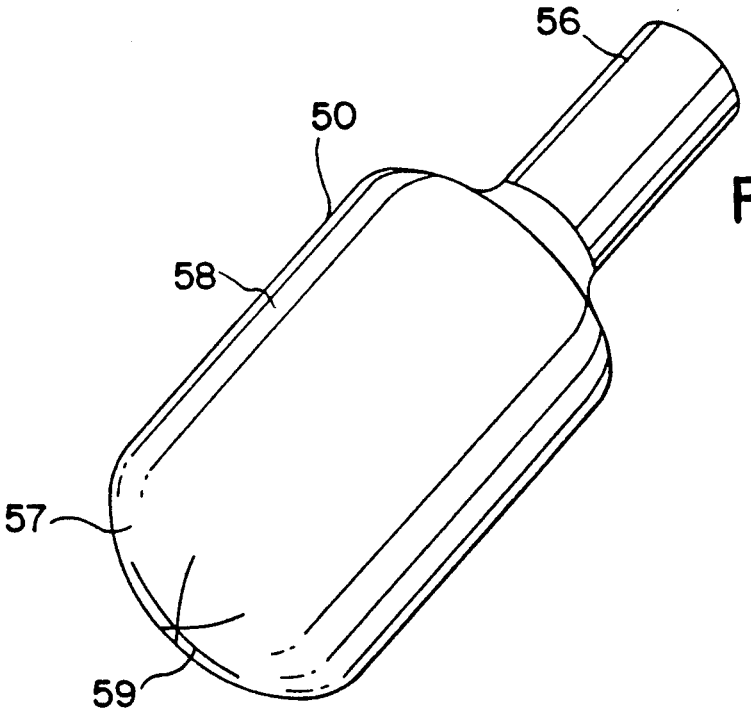
FIG. 8

PREMOLDED SUPPRESSOR SLEEVE

FIELD OF THE INVENTION

The present invention relates in general to ferrite shields for suppressing high frequency noise in cables, and in particular to a new and useful ferrite suppressor and premolded case combination which firmly secures a closed cylindrical ring of ferrite material around a cable or conductor ribbon.

Ferrite suppressors are manufactured in geometries which use about one cubic inch of ferrous oxide material cast into various cylindrical or rectangular shapes. A hole is provided in the suppressor through which a cable or wire can pass. The cables which use this type of product are data transmission electronic circuits, usually processing frequencies from computer sources. Such a wire or cable can act as an antenna by either receiving or transmitting other unwanted frequencies.

Certain Federal Communication Commission (FCC) regulations require suppression or elimination of these unwanted frequencies. Also many computer devices require the same type of suppression to enhance overall system performance. Ferrite shields installed on the cable suppress the higher, unwanted frequency signals while permitting the lower data frequencies to pass unaltered. Thus, the undesirable "antenna characteristic" of a cable is controlled.

An advancement to the original solid ferrite designs has been to split the ferrite in half, or bisect it. This allows the two halves to be jointed over the wire. A coarse and unsophisticated method of holding the halves together has been to simply tape or wrap them with a wire wrap tie.

The use of a reusable tape fastener to hold the halves of a ferrite shield together is disclosed in U.S. Pat. No. 4,983,932. The use of clam shell cases to hold the ferrite shield halves together is also disclosed in U.S. Pat. No. 5,003,278 to one of the co-inventors of the present application and U.S. Pat. No. 4,972,167. U.S. Pat. No. 4,972,167 also discloses the use of a clam shell case for enclosing a hollow but one piece closed cylinder of ferrite material.

The use of cast or molded, sleeve-shaped insulation material around conductors, junctions or other electrical parts is known from U.S. Pat. No. 3,692,922 and U.S. Pat. No. 3,891,790. An insulating sleeve having at least one deformable end is also known from U.S. Pat. No. 3,009,986.

A need remains for a ferrite ring case which is easily, yet securely, engageable onto a cable or ribbon, for shielding purposes.

SUMMARY OF THE INVENTION

An object of the present invention is to provide a sheath, sleeve, housing or casing, which is molded as one piece around a solid ferrite member having a hole therethrough for receiving a conductor such as a cable or ribbon, and wherein the solid member of ferrite is securely held to the conductor.

A further object of the present invention is to provide a premolded sleeve containing a ferrite member which can be slid onto a cable or ribbon for shielding the cable or ribbon.

By utilizing a solid ferrite member, shielding is improved in that the radiation to be absorbed flows more continuously through and around the ferrite material.

The sleeve, sheath or casing is advantageously cast, molded, injection molded, dipped, pressed, slid, or injected around the ferrite member. The ferrite member may be cylindrical or rectangular in cross section. The sleeve of synthetic material has at least one and preferable two opposite projections on opposite sides of the ferrite material for embracing and firmly engaging the cable or ribbon.

Accordingly, a further object of the present invention is to provide a noise suppressor for engagement over a cable, comprising: a core having a core passage extending from one end of the core, to an opposite end thereof, the core passage being adapted to receive a cable extending through the core, the core being made of electrical noise absorbing material; a sleeve of insulating material formed as one piece and covering the core, the sleeve extending beyond at least one end of the core and having a sleeve passage to accommodating a cable extending through the core passage; and securing means formed on the sleeve and engageable with a cable extending through the core for securing the sleeve at a selected position along the cable.

A further object of the present invention is to provide a noise suppressor for engagement over a cable which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiments of the invention are illustrated.

BRIEF DESCRIPTION OF THE DRAWINGS

In the drawings:

FIG. 7 is an end elevational view of the suppressor of FIG. 6 without a cable engaged;

FIG. 8 is a perspective view of the suppressor illustrated in FIGS. 6 and 7;

DESCRIPTION OF THE PREFERRED EMBODIMENTS

Figure 1:
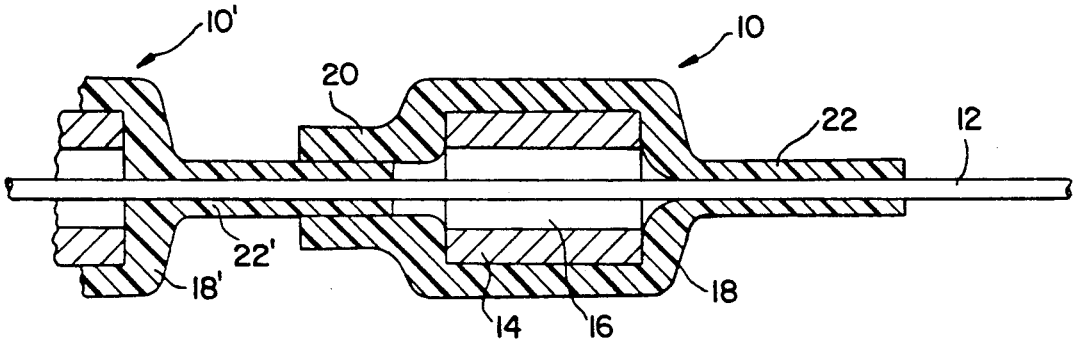
FIG. 1 is a longitudinal sectional view of one complete and one partial noise suppressor of the present invention.

Referring to the drawings in particular, the invention embodied in FIG. 1 comprises a noise suppressor generally designated 10 for engagement over a cable 12 such as a conventionally data carrying cable for use in connecting the various peripherals of a personal computer.

Figure 4:
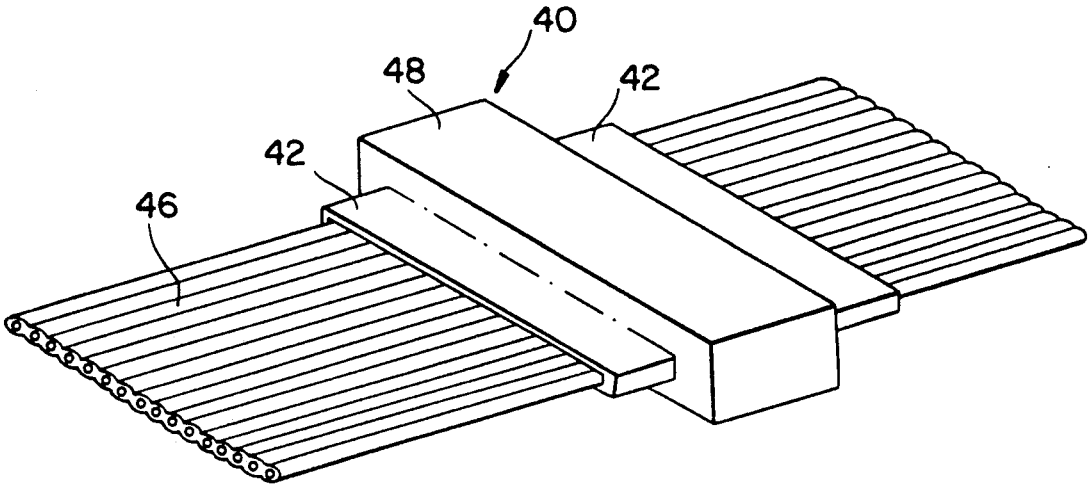
FIG. 4 is a perspective view of a further embodiment of the invention for accommodating ribbon shaped cables.

Throughout this disclosure, the term "cable" will be utilized both to identify a cable having a generally cylindrical or oval cross sections such as cable 12 in FIG. 1, and also ribbon shaped cables containing a plurality of conductors lying side by side and spaced across the width of the ribbon as shown at 46 in FIG. 4.

Suppressor 10 in FIG. 1 contains a core 14 having a core passage 16 extending from one end of the core to an opposite end thereof. Passage 16 is advantageously cylindrical as is the core 14. Core passage 16 has a diameter which is greater than the outer diameter of cable 12 for easily receiving the cable through the core. Core 14 is advantageously made of ferrite or other electrical noise absorbing material and, held at a selected location along the length of the cable 12, will absorb interference and electrical noise emanating from or existing around the cable.

A sleeve 18 of insulating, preferable synthetic or plastic material, is formed as one piece and covers the core 14. Sleeve 18 extends beyond and around the opposite ends of core 14 and includes a pair of axially extending projections 20 and 22 designed to extend along the cable at opposite ends of the ferrite core. Both projections can be cylindrical or any other shape to accommodate the shape of a cable to be received in the projections. Projection 20 is constructed with thicker walls than projection 22. This renders projection 22 more elastic and easier to expand than projection 20. The outer diameter of projection 22 is also selected to be equal to or just slightly greater than the inner diameter of projection 20. This enables the nesting of a projection 22' from an adjacent suppressor 10', into the projection 20 of suppressor 10. The synthetic material forming the suppressor sleeves 18 and 18' may be selected to have a high coefficient of friction so that small diameter projection 22' is firmly held by friction within large diameter projection 20.

This serves the dual purpose of firmly engaging the inner surfaces of the small diameter sleeve 22' against the outer surface of the cable and also permit multiple suppressors to be banked or ganged with each other along a cable. The advantages of this is that a core in each suppressor may be only half the mass and size of the total core required to fully shield the cable. Half the shielding is provided by each of two suppressors engaged on the cable. This produces a suppressor having a smaller outer diameter. This also replaces the prior technique of wrapping a cable to be shielded twice around the ferrite core. Two ferrite shields in series along the cable perform the same service.

Alternatively, the thin walled small diameter suppressor projection 22 may have an inside diameter which is smaller than the outer diameter of the cable 22. To engage a single suppressor on the cable, an end of the cable is first inserted through the thick walled large diameter projection 20 (which may have an inner diameter slightly less than or equal to the outer diameter of the cable), then through the passage 16 and, under force, through the passage of projection 22. This causes the projection 22 to expand outwardly. This resiliently and firmly engages the suppressor to the cable, preventing its being moved along the cable after it is installed.

Figure 2:
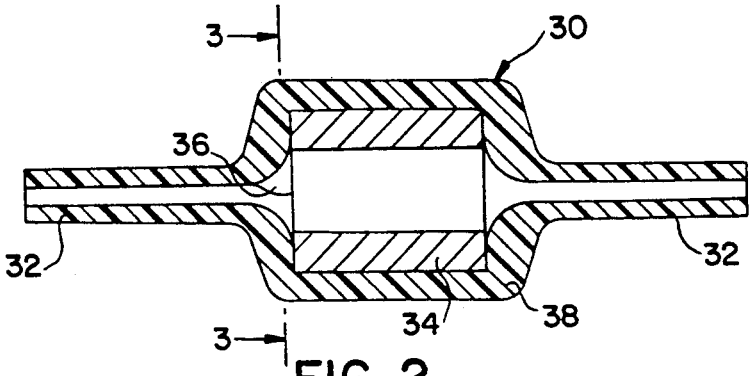
FIG. 2 is a longitudinal sectional view of a second embodiment of the present invention.
Figure 3:
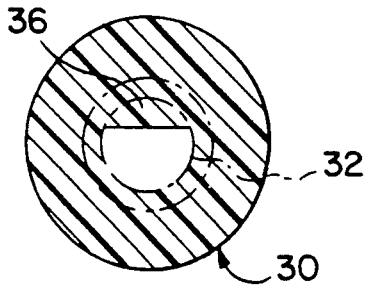
FIG. 3 is a radial sectional view taken along line 3—3 of FIG. 2.

FIG. 2 illustrates a suppressor 30 having a one piece insulating sleeve 38 engaged around a cylindrical ferrite core 34. Cylindrical projections 32, 32 are of equal dimensions and wall thicknesses. The inner passage of one or both projections 32 includes an internal pressure pad 36 shown also in FIG. 3. Pad 36 is chord-shaped and, with the insertion of a cable which is equal to or slightly greater than the inner diameter of projection 32, firmly engaged against the outer contour of the cable to hold the suppressor sleeve in place. Although a single core shaped pad is shown only in one projection of suppressor 30, multiple pads may be provided in one projection and one or more pads may be provided on both projections.

The single or multiple pads may also have shapes other than a chord, such as an undulating or tooth shape around the inner diameter of the projection. In this regard, it is noted that the inside diameter of the passage through the ferrite core must always be at least slightly larger than the outer diameter of the cable since the ferrite core has no resiliency and may only accommodate smaller dimensioned cables therethrough.

Figure 5:
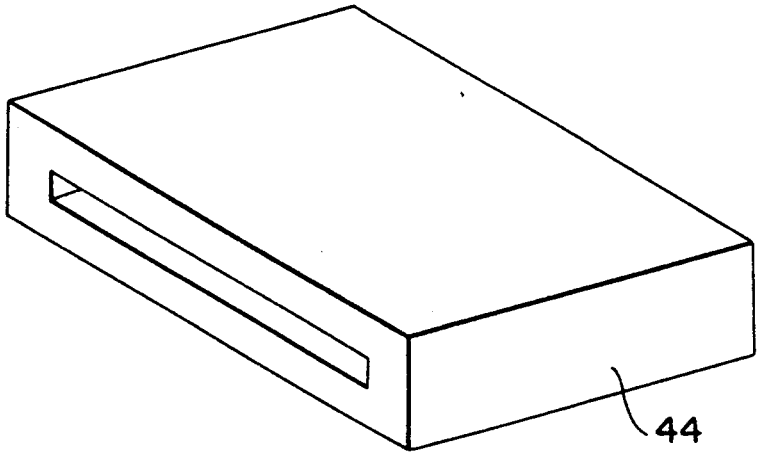
FIG. 5 is a perspective view of a solid core of noise suppressing material used in the suppressor of FIG. 4.

FIGS. 4 and 5 illustrate a suppressor 40 according to the present invention which includes an oblong or rectangular passage for receiving a ribbon shaped cable 46. As with the synthetic sleeve of suppressors 10 and 30, suppressor 40 also comprises an insulating enclosure 48 having a passage therethrough defined by a pair of projections 42. The projections 42 may be of the same of different wall thicknesses and include inner pads for exerting pressure on the ribbon 46. One or both projections 42 may also be sufficiently thin walled and have a small dimension slit, so that force may be exerted on a ribbon 46 to squeeze the ribbon into the ferrite core and past the sleeves. The resiliency of the sleeves thus holds the suppressor, and in particular the core member 44, in place along the ribbon.

Figure 6:
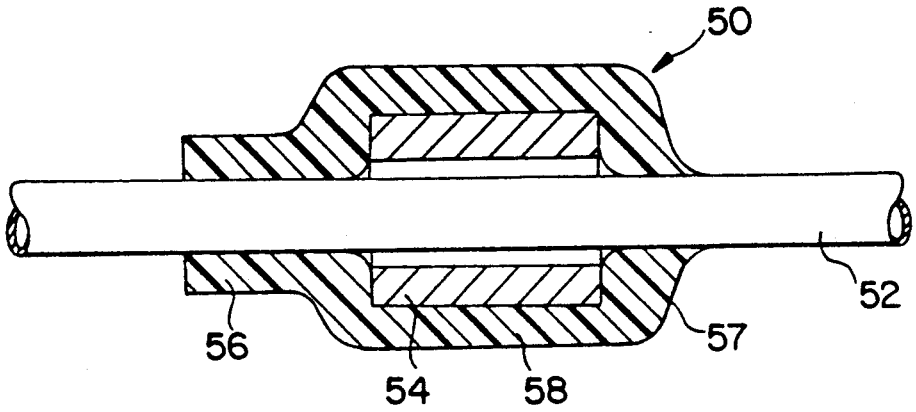
FIG. 6 is a longitudinal sectional view of a further embodiment of the invention.

FIGS. 6, 7 and 8 illustrate a further embodiment of the invention comprising a suppressor generally designated 50 for a cable 52 which is cylindrical, oval or even ribbon shaped.

Suppressor 50 comprises an enclosing sheath or sleeve 58 which extends beyond the opposite ends of a cylindrical or other shaped core 54. A cylindrical or other shaped projection 56 extends at one end of sleeve 58 while the other end of the sleeve shown at 57 is initially closed as illustrated in FIGS. 7 and 8. Unlike the securing means of the other illustrated embodiments which are formed by pads or the resiliency of the projections, initially closed end 57 of sleeve 58 contains one or more slits 59 which are preferably in a star pattern. The resiliency of the synthetic material forming sleeve 58, forms resulting teeth between the slits 59 to be deformed and spread outwardly as a cable 52 is initially slid into projection 56, through core 54 and out through the sleeve end 57 and slots 59.

Figure 9:
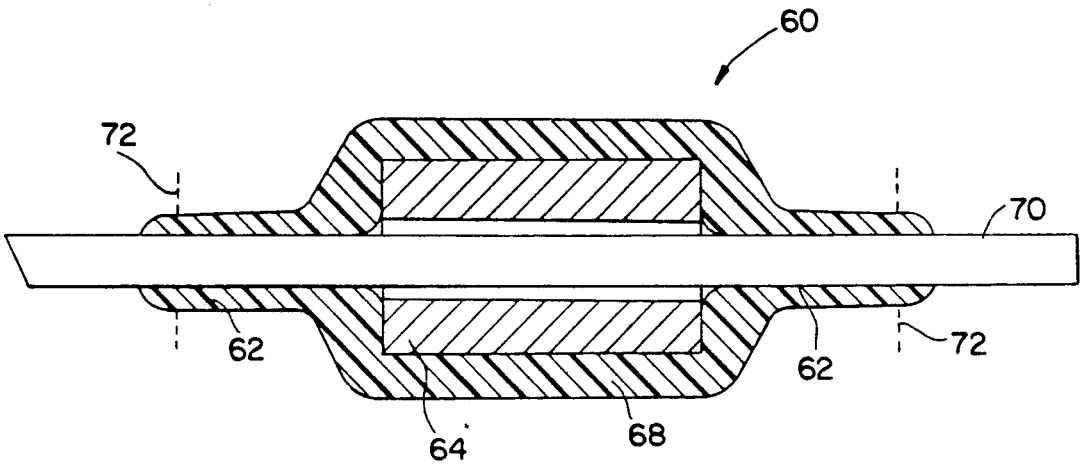
FIG. 9 is a view similar to FIG. 2, illustrating a dipping process for making the invention.

FIG. 9 illustrates a dipping process for making the present invention which utilizes a mandrel 70 that is approximately equal to or slightly smaller than the outer diameter of a cable to be supplied with the suppressor 60. A core 64 is engaged around the mandrel and then the mandrel with core is dipped into a synthetic polymer or plastic. This forms a sleeve 68 with projections 62, 62 on opposite ends thereof around the core and mandrel. After curing of the plastic, mandrel 70 is removed. Before or after removal of the mandrel, the projections are cut flush at cut lines 72, 72. One or both cut lines may be utilized. Alternately, if the dipping process is sufficiently accurate, no cutting is necessary.

A still further manner of engaging the resilient sleeve over the core is to provide a resilient sleeve which initially has the diameter of projections 32, 32 in the embodiment of FIG. 2, the sleeve being thereafter pressed and slid over the core, by virtue of the resiliency in the material making the sleeve, until it is in the position shown in FIG. 2. Such a sleeve may be with or without pads 36.

Figure 10:
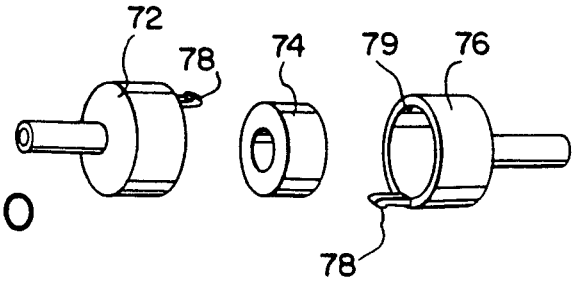
FIG. 10 is an exploded perspective view of an embodiment of the invention utilizing two sleeve halves which are slid into engagement with each other over a ferrite core.
Figure 11:
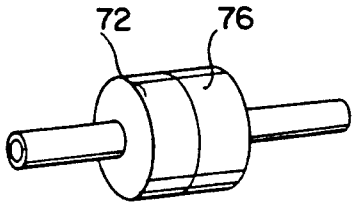
FIG. 11 shows the embodiment of FIG. 10 in its closed condition.

FIG. 10 illustrates another embodiment of the invention where core 74 is enclosed between sleeve halves 72 and 76 which each have large diameter bodies and small diameter projections. One or more toothed tabs 78 in the rim of one sleeve half is engageable into one or more recesses 79 of the other sleeve half for securing the two sleeve halves together as shown in FIG. 11. A still further embodiment of the invention can utilize sleeve halves similar to those shown in FIG. 10, but with longer larger diameter body portions. In this way, one body portion can be engaged over most of the core 74 with the other sleeve half being slid and telescoped over the first sleeve half. In this way a double layer of insulation is closely engaged around the outer circumference core 74. The high friction characteristics of the resilient material making up the sleeve halves prevent their being disengaged from each other after they are engaged onto the core.

Figure 12:
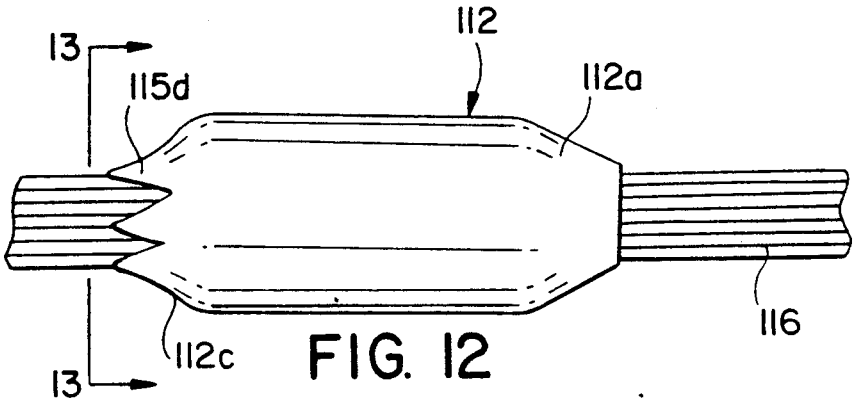
FIG. 12 is a side elevational view of another embodiment of the invention which is similar to that of FIG. 6.
Figure 13:
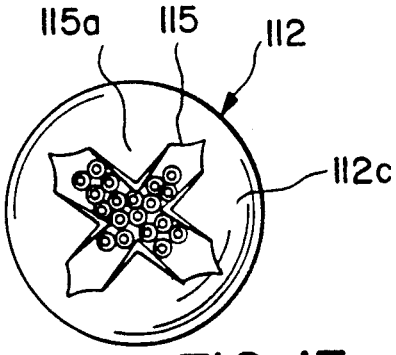
FIG. 13 is an end elevational view taken along line 13—13 of FIG. 12.

Turning to the embodiment of FIGS. 12 and 13, a supressor 112 containing a ferrite ring core (not shown) has a blunt open end 112*a* and an initially rounded end 112*c* having an open cut pattern best shown in FIG. 13. The cut pattern 115 defines a plurality of projections 115*a* and 115*b* which can be spread apart by a passing bundle of cables 116. This effectively holds the bundles together in a particular configuration. While the cut pattern 115 has larger and wider cross shaped arms than the slit pattern of FIG. 7, the patterns is still referred to as one or more slits for the purpose of this disclosure.

Advantageously, the material of the insulating sleeve in any one of the illustrated embodiments may be neoprene, santoprene, polyproplene, nylon, polyurethane, or a wide variety of other commercially available insulating materials. While preferably, the material is soft and resilient, this is not essential in all embodiments of the invention.

While the specific embodiments of the invention have been shown and described in detail to illustrate the application of the principles of the invention, it will be understood that the invention may be embodied otherwise without departing from such principles.

What is claimed is:

1. A preformed noise suppressor for engagement over a cable, comprising:

a cylindrical ring shaped core having a core passage extending from one end of the core, to an opposite end thereof, the core passage being adapted to receive a cable extending through the core, the core being made of electrical noise absorbing material;

a one piece cylindrical preformed sleeve of resilient insulating material covering the core, the sleeve extending beyond both ends of the core and having a sleeve passage to accommodating a cable extending through the core passage; and securing means formed as one piece with the sleeve and engageable with a cable extending through the core for securing the sleeve at a selected position along the cable;

the sleeve comprising a main cylindrical portion extending around the core and having an inside diameter defining part of the sleeve passage, a cylindrical projection having a smaller inside and outside diameter than the main portion, extending outwardly from the main portion, the sleeve passage extending through the projection, the securing means comprising the projection for frictionally engaging a cable extending through the core, and a circular thick wall portion of the sleeve extending on an opposite side of the main portion from the projection, the thick wall portion having a thicker wall thickness than the projection and a smaller inside and outside diameter than the main portion, the projection being longer than the thick wall portion.

2. A suppressor according to claim 1, wherein the projection with thinner wall thickness has an outside diameter which is approximately equal to an inside diameter of the projection having the larger wall thickness.

3. A suppressor according to claim 1, wherein the core is in the form of a single member of electrical noise absorbing material with the core passage extending therethrough.

* * * * *